US007005039B2

(12) United States Patent
Bartelmuss et al.

(10) Patent No.: US 7,005,039 B2
(45) Date of Patent: Feb. 28, 2006

(54) DEVICE FOR ADJUSTING THE POSITION OF A WIPER STRIP WITH RESPECT TO THE SCREEN IN A PAPERMAKING PLANT

(76) Inventors: Klaus Bartelmuss, NR. 63, A-8883 Teufenbach (AT); Heinz Bartelmuss, NR. 63, A-8883 Teufenbach (AT)

( * ) Notice: Subject to any disclaimer, the term of this patent is extended or adjusted under 35 U.S.C. 154(b) by 430 days.

(21) Appl. No.: 10/282,973

(22) Filed: Oct. 29, 2002

(65) Prior Publication Data

US 2003/0136539 A1 Jul. 24, 2003

(30) Foreign Application Priority Data

Jan. 24, 2002 (AT) ..... A 112/2002

(51) Int. Cl.
*D21F 1/32* (2006.01)
*D21F 1/54* (2006.01)

(52) U.S. Cl. ..... 162/352; 162/274; 162/348

(58) Field of Classification Search ..... 162/199, 162/202, 203, 208, 211, 217, 348–352, 371, 162/272, 274, 281, 308, 310, 300, 301, 363, 162/366, 374; 277/300, 306–7
See application file for complete search history.

(56) References Cited

U.S. PATENT DOCUMENTS

| | | | | | |
|---|---|---|---|---|---|
| 3,585,105 | A | * | 6/1971 | Stuebe | 162/211 |
| 4,865,692 | A | * | 9/1989 | Kade et al. | 162/352 |
| 5,078,835 | A | * | 1/1992 | Schiel et al. | 162/352 |
| 5,129,992 | A | * | 7/1992 | Schiel et al. | 162/352 |
| 5,486,270 | A | * | 1/1996 | Schiel | 162/352 |
| 5,607,554 | A | * | 3/1997 | Poikolainen | 162/210 |
| 5,660,689 | A | * | 8/1997 | Bartelmuss et al. | 162/352 |
| 6,379,503 | B1 | * | 4/2002 | Jansson | 162/199 |

* cited by examiner

*Primary Examiner*—Eric Hug
(74) *Attorney, Agent, or Firm*—Laurence A. Greenberg; Werner H. Stemer; Ralph E. Locher

(57) ABSTRACT

A device for adjusting the position of the wiper strip on the screen in a papermaking plant regulates the contact pressure with which the wiper strip bears on the screen. The wiper strip is fixed to a supporting bar and the supporting bar is configured such that it can be moved with respect to the screen counter to the action of a spring device, in particular an air spring, in order to adjust its position with respect to the screen. A plurality of holding bars are provided along the supporting bar, that can be adjusted in terms of their effective thickness in relation to pressing the wiper strip against the screen.

11 Claims, 3 Drawing Sheets

DEVICE FOR ADJUSTING THE POSITION OF A WIPER STRIP WITH RESPECT TO THE SCREEN IN A PAPERMAKING PLANT

BACKGROUND OF THE INVENTION

Field of the Invention

The present invention lies in the field of paper production machinery. More specifically, the invention relates to a device for adjusting the position of a wiper strip with respect to the screen in a papermaking plant in order to regulate the contact pressure with which the wiper strip bears on the screen. The wiper strip is fixed to a supporting bar and the supporting bar is configured such that it can be moved with respect to the screen on at least one holding bar, counter to the action of a spring device, in particular an air spring.

In prior art devices of this type, a spring device is provided that acts between the holding bar and the supporting bar, in particular an air spring, by means of which the wiper strip can be pressed against the screen. If the screen has an unevenness or the like, in this way the wiper strip can be displaced counter to the action of the spring device.

However, firstly the prior art device does not correspond to the requirements, since the position of the wiper strip is not defined. Secondly, the wiper strip can also assume an oblique position in terms of its distance with respect to the screen, as a result of which the wiper strip is pressed against the screen with different intensity over the width of the screen. Since, as a result, its action over the width of the screen is different, the requirements on the functionality of the wiper strip are not met.

SUMMARY OF THE INVENTION

It is accordingly an object of the invention to provide a device for adjusting the position of the wiper strip with respect to the screen of a papermaking plant, which overcomes the above-mentioned disadvantages of the heretofore-known devices and methods of this general type.

With the foregoing and other objects in view there is provided, in accordance with the invention, a device for adjusting a position of a wiper strip relative to a screen in a papermaking plant, comprising:

a supporting bar carrying the wiper strip;

a plurality of holding bars disposed along the supporting bar for moving the supporting bar with respect to the screen, each of the holding bars having an effective thickness defining a force of a contact pressure between the wiper strip and the screen; and a spring device, preferably an air spring, for adjusting the effective thickness of each of the holding bars for regulating a contact pressure between the wiper strip and the screen along the supporting bar.

In accordance with an added feature of the invention, each of the holding bars is a two-part assembly with two parts, and a wedge-shaped actuating element is disposed to adjust a mutual spacing of the two parts of the holding bars.

In accordance with an additional feature of the invention, the two parts of the holding bars and the wedge-shaped actuating element are formed with mutually associated grooves and strips guided in the grooves and extending in an actuating direction of the actuating element.

In accordance with another feature of the invention, an actuating device connects the actuating elements and commonly displaces the same. In a preferred embodiment, the actuating device includes a screw spindle.

In accordance with again an added feature of the invention, the holding bars have spring devices assigned thereto, for biasing the holding bars for displacement in a direction towards the screen, and wherein stops are disposed to limit an actuating movement of the holding bars. Preferably, a base bar supports the holding bars, and the stops are projections formed on and projecting from the base bar, for instance in the form of stop bars formed on the base bar.

In accordance with a concomitant feature of the invention, a movable sleeve encloses the holding bars. The movable sleeve is preferably formed as a bellows.

In further summary, the objects of the invention are achieved by a plurality of holding bars that are provided along the supporting bar, which can be adjusted in terms of their effective thickness in relation to pressing the wiper strip against the screen.

The holding bars are preferably of two-part design, and the mutual spacing of the two parts of the holding bars can be adjusted by means of a wedge-like actuating element. In this case, the two parts of the holding bars, on the one hand, and the wedge-like actuating element, on the other hand, can be formed with mutually associated grooves and strips guided in the grooves.

According to a preferred embodiment, the actuating elements assigned to the holding bars arranged over the length of the supporting bar are connected to one another for common displacement by means of an actuating device. The actuating device preferably has a screw spindle. In addition, the holding bars are preferably assigned spring devices, by means of which the holding bars are loaded for displacement in the direction of the screen, their actuating movement being limited by stops. For this purpose, projections projecting from a base bar, in particular stop bars, can be provided. According to a preferred embodiment, in addition the holding bars are enclosed by a movable sleeve, in particular by a bellows.

Other features which are considered as characteristic for the invention are set forth in the appended claims.

Although the invention is illustrated and described herein as embodied in a device for adjusting the position of a wiper strip with respect to the screen in a papermaking plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
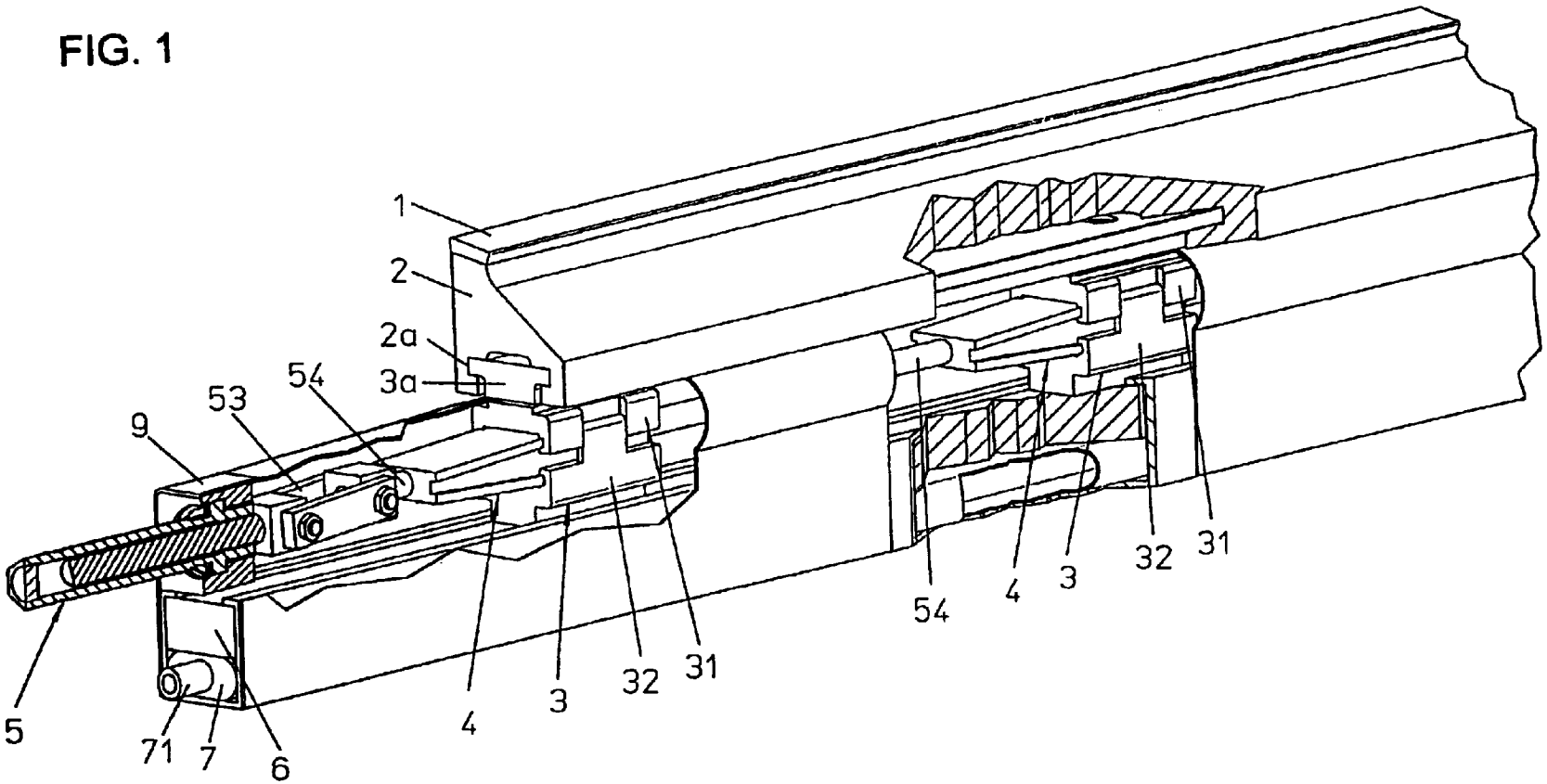
FIG. 1 is a partly broken, perspective view of a device according to the invention.

Referring now to the figures of the drawing in detail and first, particularly, to FIG. 1 thereof, the device according to the invention comprises a supporting bar 2 for a wiper strip 1. Both strips 1 and 2 extend over the width of the screen in the papermaking plant, i.e., they have a length of several meters. The wiper strip 1 bears closely on the screen, which is moved at a speed of 40 m/sec, for example, during operating of the plant.

On its lower side illustrated in the drawing, the supporting bar 2 or carrier bar 2 is formed with an approximately T-shaped groove 2*a*, with which it is pushed onto T-shaped projections 3*a* of a plurality of holding bars 3 arranged along the supporting bar 2. The holding bars 3 comprise an upper part 31 and a lower part 32, both parts being adjustable in terms of their distance from each other. In order to adjust this distance from each other, actuating elements 4 are provided, which can be controlled by an actuating device 5. The lower parts 32 of the holding bars 3 are fixed to a base bar 6 extending over the width of the screen. Underneath the base bar 6 there is a spring device 7 in the form of a flexible tube, which can be acted on with compressed air from a compressed-air source, such as from a pressure reservoir via a line 71.

Figure 1A:
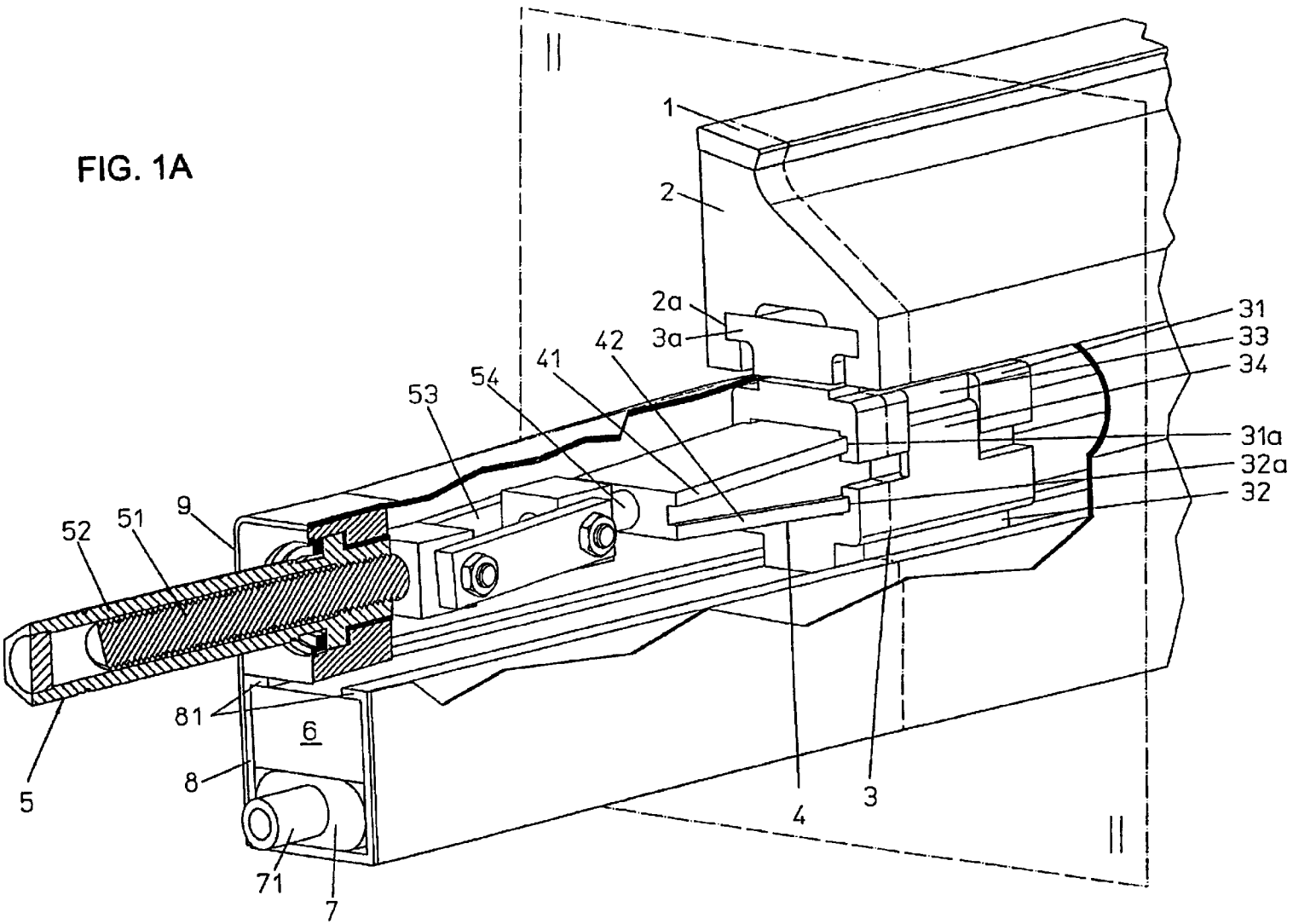
FIG. 1A is an enlarged view of a detail of FIG. 1.

As can be seen in particular from FIG. 1A, the actuating device 5 comprises a screw spindle 51, which can be adjusted by rotating a threaded sleeve 52 mounted fixed to the frame, a link 53 fixed to the screw spindle 51 and an actuating rod 54. The actuating element 4 is formed on its two long walls with laterally projecting strips 41 and 42 which are aligned with each other in a wedge shape, project into associated grooves 31*a* and 32*a* in the two parts 31 and 32 of the holding bar 3 and are guided in said grooves. The first actuating element 4 is followed by a further actuating rod 54, to which a further actuating element 4 is fixed. Over the length of the supporting bar 2, a plurality of holding bars 3 and actuating elements 4 associated therewith are provided.

In addition, the upper parts 31 of the holding bar 3 are formed with lateral recesses 33, into which extensions 34 projecting from the lower parts 32 project. By means of the extensions 34 projecting into the recesses 33, the two parts 31 and 32 are guided at their mutual distance from each other during displacement.

The base bar 6 and the flexible compressed-air tube 7 are surrounded by a housing 8, which is formed with strips 81 aligned towards each other and against which the upper side of the base bar 6 is pressed by the flexible compressed-air tube 7. In addition, the holding bars 3 are enclosed by an extensible covering 9.

Figure 2:
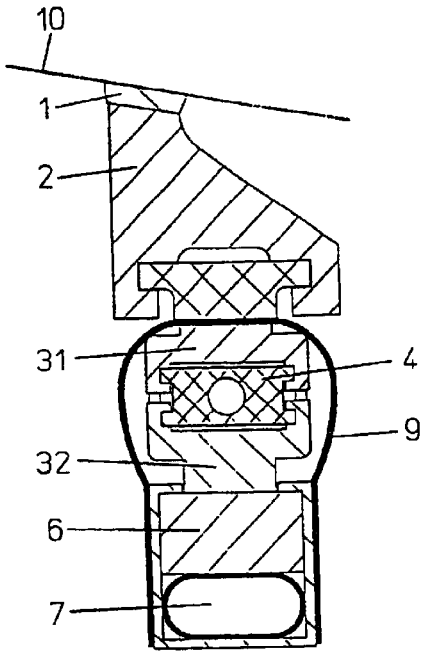
FIGS. 2, 2A are sectional views taken along the plane II—II in FIG. 1A, showing the holding bar in two different operating positions.
Figure 2A:
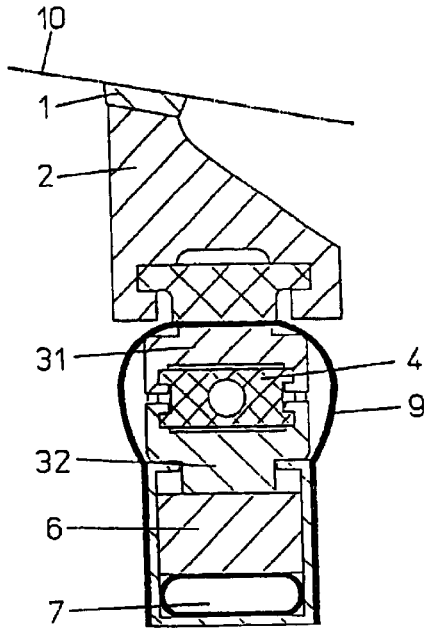
Figure 3:
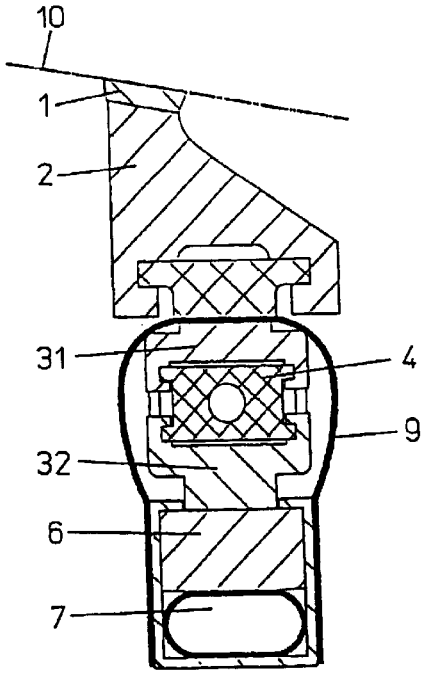
FIGS. 3, 3A are sectional views taken along the plane II—II in FIG. 1A, showing the holding bars with a changed setting and at the same time in two different operating positions of the same.
Figure 3A:
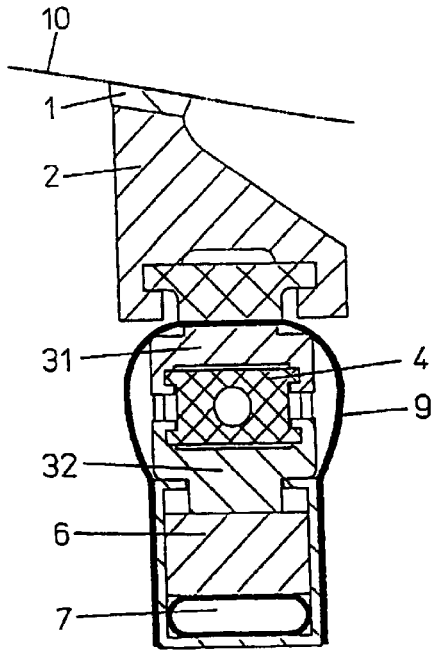

FIGS. 2 and 2A, as well as FIGS. 3 and 3A, illustrate a screen 10 (also referred to as a paper forming fabric or wire).

The device operates as follows:

As a result of action on the flexible compressed-air tube 7, the base bar 6 is pressed against the strips 81, as a result of which the base bar 6, the holding bars 3 and the supporting bar 2 assume exactly defined positions. By this means, the position of the wiper strip 1 with respect to the screen 10, and therefore the contact pressure with which the wiper strip 1 bears on the screen 10, are determined accurately. A first position of the wiper strip 1 with respect to the screen 10 is illustrated in FIG. 2.

If the wiper strip 1 has to give way because of an unevenness of the screen 10, this movement takes place counter to the action of the flexible compressed-air tube 7. This position is illustrated in FIG. 2A.

When the overall position of the wiper strip 1 with respect to the screen 10 is to be changed, as a result of which its contact pressure is changed, the threaded rod 51 is rotated in the threaded tube 52, as a result of which the actuating elements 4 are displaced via the link 53 and via the actuating rods 54. As a result, the upper and lower parts 31 and 32 of the holding bars 3 are moved away from each other or toward each other in terms of their vertical position via the wedge-like strips 41 and 42. In this way, the position of the wiper strip 1 with respect to the screen 10 is changed and that pressure with which the wiper strip 1 bears on the screen 10 is adjusted.

A position of the wiper strip 1 changed in this way with respect to the screen 10 is illustrated in FIGS. 3 and 3A.

This provides a device with which the position of the wiper strip with respect to the screen, and therefore that pressure with which the wiper strip is pressed against the screen, can be adjusted accurately, in spite of the fact that the position of the wiper strip with respect to the screen can be changed counter to the action of a spring device, in particular an air spring.

We claim:

1. A device for adjusting a position of a wiper strip relative to a screen in a papermaking plant, comprising:

a supporting bar carrying the wiper strip;

a plurality of holding bars disposed along said supporting bar for moving said supporting bar with respect to the screen, each of said holding bars being a two-part assembly with two parts;

a spring device disposed to adjust a contact pressure between the wiper strip and the screen along said supporting bars; and a wedge-shaped actuating element disposed to adjust a mutual spacing of said two parts of said holding bars.

2. The device according to claim 1, wherein said spring device is an air spring.

3. The device according to claim 1, wherein said two parts of said holding bars and said wedge-shaped actuating element are formed with mutually associated grooves and strips guided in said grooves and extending in an actuating direction of said actuating element.

4. The device according to claim 1, which comprises an actuating device connecting and commonly displacing said actuating elements.

5. The device according to claim 4, wherein said actuating device includes a screw spindle.

6. The device according to claim 1, wherein said holding bars have spring devices assigned thereto, for biasing said holding bars for displacement in a direction towards the screen, and wherein stops are disposed to limit an actuating movement of said holding bare.

7. The device according to claim 6, which comprises a base bar supporting said holding bars, and wherein said stops are projection formed on and projecting from said base bar.

8. The device according to claim 7, wherein said stops are stop bars formed on said base bar.

9. A device for adjusting a position of a wiper strip relative to a screen in a papermaking plant, comprising:

a supporting bar carrying the wiper strip;

a plurality of holding bars disposed along said supporting bar for moving said supporting bar with respect to the screen;

a spring device disposed to adjust a contact pressure between the wiper strip and the screen along said supporting bar; and a movable sleeve enclosing said holding bars.

10. The device according to claim 9, wherein said movable sleeve is a bellows.

11. A device for adjusting a position of a wiper strip relative to a screen in a papermaking plant, comprising:

a supporting bar carrying the wiper strip;

a plurality of holding bars disposed along said supporting bar for moving said supporting bar with respect to the screen, each of said holding bars being a two-part assembly with two parts;

a spring device disposed to bias said supporting bar and said wiper strip toward the screen; and an actuating element disposed to adjust a mutual spacing between said two parts of said holding bars.

* * * * *